US005873727A

United States Patent [19]

Barlow

[11] Patent Number: 5,873,727

[45] Date of Patent: Feb. 23, 1999

[54] APPARATUS FOR MOVING GAME PIECES DURING A GAME PLAYING PERIOD AND AN ASSOCIATED METHOD OF PLAYING A GAME

[75] Inventor: Gordon Barlow, Highland Park, Ill.

[73] Assignee: Fundex Games, Ltd., Indianapolis, Ind.

[21] Appl. No.: 926,203

[22] Filed: Sep. 9, 1997

[51] Int. Cl.[6] ..... A63H 17/25; A63H 18/08; A63F 3/00

[52] U.S. Cl. ..... 434/128; 446/237; 446/332; 446/446; 446/467; 273/273; 273/290

[58] Field of Search ..... 446/467, 410, 446/237, 332, 434, 444, 445, 446, 447, 448, 449, 238; 273/237, 273, 290; 434/128

[56] References Cited

U.S. PATENT DOCUMENTS

| | | | |
|---|---|---|---|
| 2,438,616 | 3/1948 | Mosher | 446/238 |
| 2,659,317 | 11/1953 | Bonanno et al. | 446/467 |
| 2,782,730 | 2/1957 | Frank | 446/467 |
| 3,407,533 | 10/1968 | Hughes | 446/467 |
| 3,677,548 | 7/1972 | Hincz | 273/273 |
| 4,524,967 | 6/1985 | Hanson et al. | 273/273 |
| 4,799,916 | 1/1989 | McKay et al. | 446/467 |
| 4,938,481 | 7/1990 | Goldfarb et al. | 273/290 |
| 5,190,296 | 3/1993 | Sainsbury | 273/273 |
| 5,207,431 | 5/1993 | Joseph | 273/290 |

*Primary Examiner*—Robert A. Hafer
*Assistant Examiner*—M. Priddy
*Attorney, Agent, or Firm*—Maginot, Addison & Moore

[57] ABSTRACT

An apparatus for moving game pieces during a game playing period includes a movement device having a support which supports a number of game pieces, wherein the movement device moves the number of game pieces relative to the support during the game playing period. The apparatus also includes a towing apparatus for transporting the movement device from a first location to a second location during the game playing period. The towing apparatus is movable in a predetermined path of movement. A method of playing a game with a number of players is also disclosed.

9 Claims, 9 Drawing Sheets

APPARATUS FOR MOVING GAME PIECES DURING A GAME PLAYING PERIOD AND AN ASSOCIATED METHOD OF PLAYING A GAME

BACKGROUND OF THE INVENTION

The present invention generally relates to an apparatus and method for playing a game. The present invention also relates to an apparatus for moving game pieces during a game playing period and an associated method of playing the game.

Many games are designed to mentally stimulate and educate children. Specifically, these games attempt to exercise a child's memory while teaching him or her various fundamentals such as mathematics, spelling, geometry, or colors. The memory exercise associated with these games can involve a plurality of game pieces with each game piece having an indicia (e.g. a number) positioned thereon that is related to the subject matter being taught. One way of playing such games is to show a game piece and some indicia positioned thereon to a player (i.e. a child), and then place the game piece back among the other game pieces such that the indicia is no longer visible to the player. The player, after a certain amount of time, is then required to retrieve or identify the game piece he or she was previously shown. Playing these games in the above described manner exercises the child's memory and helps educate the child with respect to the subject matter being taught.

However, a problem with many of the games that involve the aforementioned educational and memory exercise is that they are not sufficiently entertaining to keep a child's interest. This lack of entertainment can be attributed to the static nature of the game. Furthermore, in a number of these existing games, it is possible for the child to associate a given indicia with a particular game piece due to a physical characteristic of the game piece. For example, if the game is attempting to teach mathematics to a player and a game piece associated with the number "seven" (7) gets scratched, the child will eventually be able to identify this game piece by the scratch rather than through the intended manner defined by the rules of the game. This problem decreases the value of the educational and memory exercise, and contributes to the child losing interest in the game.

The present invention is directed to overcoming one or more of the problems set forth above.

SUMMARY OF THE INVENTION

In accordance with one embodiment of the present invention, there is provided an apparatus for moving game pieces during a game playing period. The apparatus includes a movement device having a support which supports a number of game pieces. The movement device moves the number of game pieces relative to the support during the game playing period. The apparatus also includes a towing apparatus for transporting the movement device from a first location to a second location during the game playing period. The towing apparatus is movable in a predetermined path of movement.

In accordance with another embodiment of the present invention there is provided an apparatus for moving game pieces during a game playing period. The apparatus includes a rail and a support for holding a number of game pieces. The apparatus also includes a towing apparatus for transporting the support from a first location to a second location during the game playing period. The towing apparatus includes (1) a first drive foot which engages the rail, and (2) a motor mechanically coupled to the first drive foot for rotating the first drive foot so as to advance the towing apparatus along the rail.

In accordance with yet another embodiment of the present invention there is provided a method of playing a game with a number of players. The method includes the steps of: (a) moving a number of game pieces relative to a support during a game playing period, (b) transporting the support from a first location to a second location during step (a), (c) removing a first game piece, of the number of game pieces, from the support when the transport apparatus is located at the first location, (d) determining if the first game piece matches a first game piece indicator associated with the first location, (e) retaining the first game piece at the first location if the first game piece matches the first game piece indicator, and (f) returning the first game piece to the support if the first game piece does not match the first game piece indicator.

It is therefore an object of the present invention to provide a new and useful apparatus for moving game pieces during a game playing period.

It is another object of the present invention to provide an improved apparatus for moving game pieces during a game playing period.

It is still another object of the present invention to provide a new and useful method of playing a game with a number of players.

It is yet another object of the present invention to provide an improved method of playing a game with a number of players.

It is still another object of the present invention to provide a game that will mentally stimulate a child.

It is yet another object of the present invention to provide a game that will entertain a child.

The above and other objects, features, and advantages of the present invention will become apparent from the following description and attached drawings.

DETAILED DESCRIPTION OF THE PREFERRED EMBODIMENT

Figure 1:
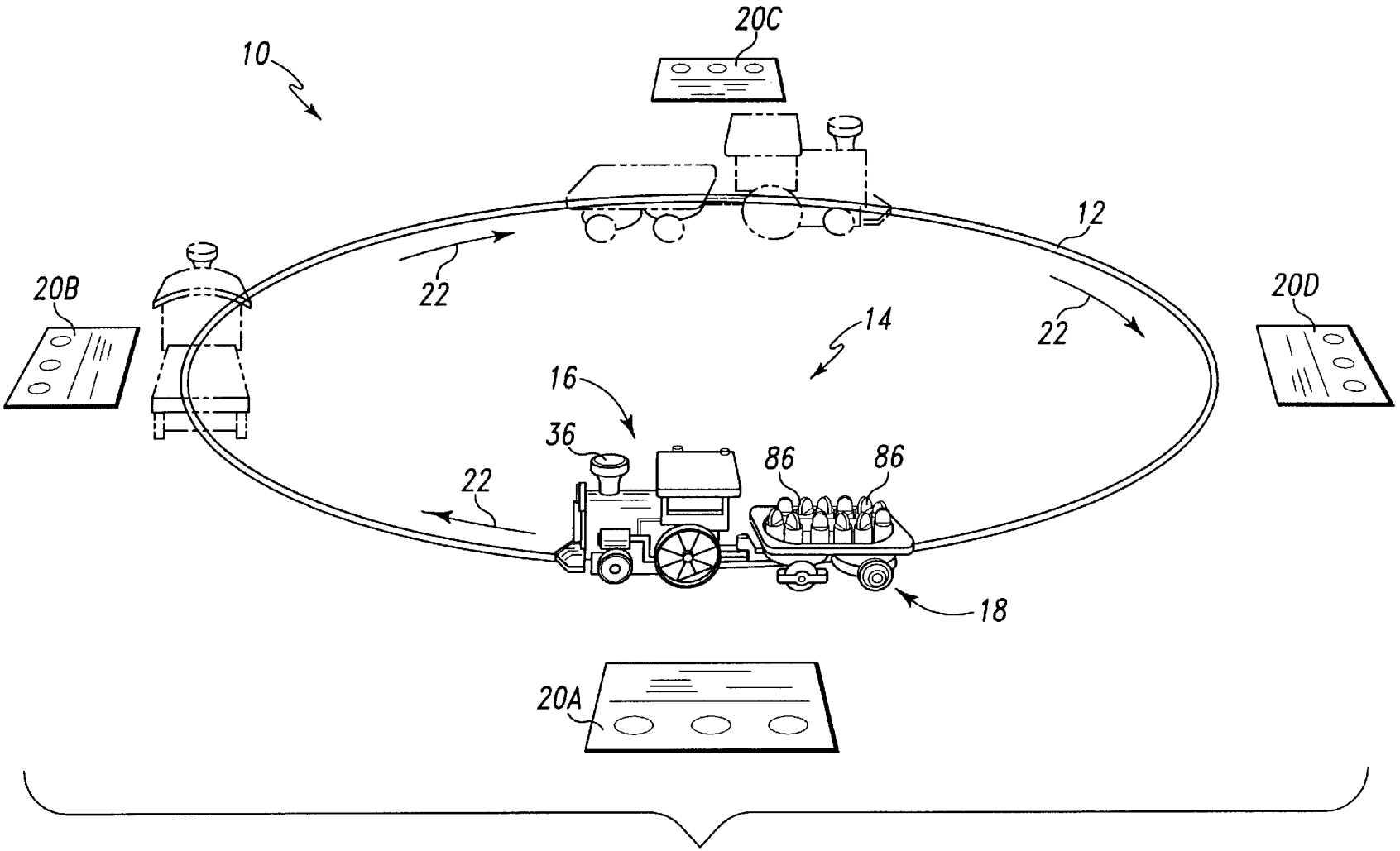
FIG. 1 is a perspective view of a game which incorporates the features of the present invention therein (note that movement of the apparatus is depicted by showing the transport apparatus of the game in solid lines at a first position, and then showing the transport apparatus in phantom at a second and third position)

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown a game 10 which incorporates the features of the present invention therein. Game 10 includes a rail 12, game piece indicators 20A, 20B, 20C, and 20D, a number of game pieces 86, and a transport apparatus 14. Transport apparatus 14 includes a towing apparatus 16 and a movement device 18.

Figure 2:
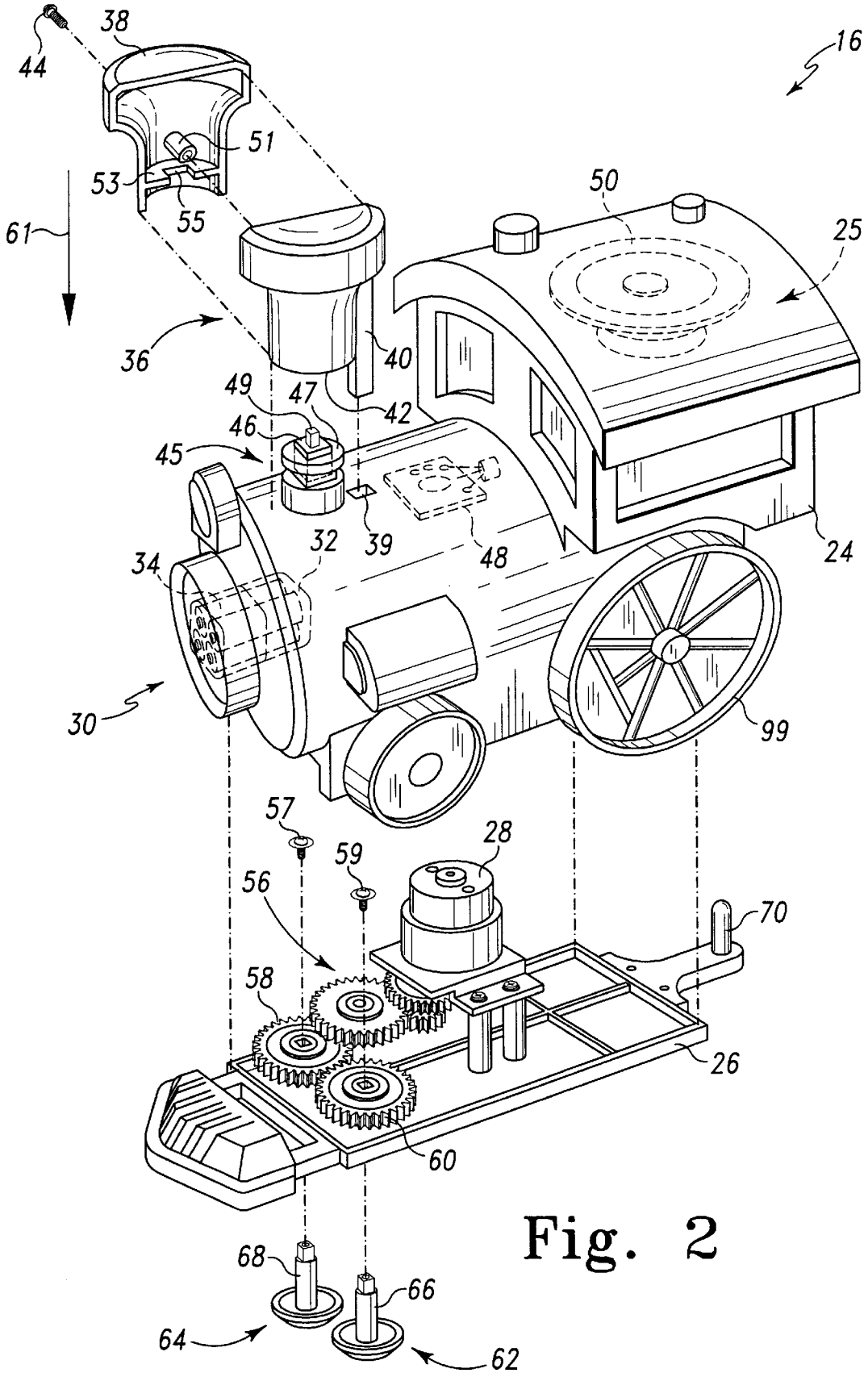
FIG. 2 is an enlarged exploded perspective view of the towing apparatus of the transport apparatus of FIG. 1.

Referring now to FIG. 2, towing apparatus 16 includes a base 26 and a housing 24 having an interior chamber 25 defined therein. Towing apparatus 16 also includes a motor 28, a hitch 70 secured to base 26, a gear set 56, a gear 58, a gear 60, a drive foot 62, a drive foot 64, a shaft 66 and a shaft 68. Towing apparatus 16 further includes a power supply 30, an actuator 36, a noise signal generator 48, a speaker 50, and a pair of idler wheels 99 (note only one idler wheel 99 is shown in FIG. 2).

Noise signal generator 48 is positioned within interior chamber 25 of housing 24. Speaker 50 is secured to housing 24 and is positioned within interior chamber 25. Power supply 30 includes an enclosure 32 and four batteries 34 contained within enclosure 32. Enclosure 32 is secured to housing 24 and is positioned within interior chamber 25. Enclosure 32 is further positioned within interior chamber 25 such that enclosure 32 is located approximately directly above drive foot 62 and drive foot 64. Idler wheels 99 are rotatably attached to housing 24 such that each idler wheel 99 can rotate independently of the other. It should be noted that positioning power supply 30 approximately directly above drive feet 62, 64 is beneficial since the weight provided by the power supply 30 is applied downwardly by gravity so as to enhance the frictional engagement between rail 12 and drive feet 62, 64 during operation of towing apparatus 16.

Actuator 36 includes a right half 38, a left half 42, and a guide pin 40 secured to left half 42. Actuator 36 also includes an internally threaded boss 51 and a plate 53, both secured to right half 38. Plate 53 has an cutout 55 defined therein. It should be understood that left half 42 also has an internally treaded boss (not shown) and a plate (not shown) secured thereto which are similar to boss 51 and plate 53. Specifically, the boss which is secured to left half 42 is also internally threaded, and the plate secured to left half 42 also has a cutout portion defined therein. Actuator 36 further includes a column 45 and a spring loaded single-pole-double-throw (SPDT) switch 46. Column 45 has a passageway (not shown) defined therethrough. Column 45 also has a lip 47 attached to an end thereof. Switch 46 includes a plunger 49.

One end of column 45 is attached to housing 24 such that the passageway defined through column 45 leads to interior chamber 25. Column 45 is also attached to housing 24 such that column 45 is adjacent to a hole 39 defined in housing 24. Lip 47 is attached to the end of column 45 opposite to the end attached to housing 24. Switch 46 is positioned within the passageway defined through column 45 such that switch 46 is supported on a brace (not shown) positioned within the passageway. Having switch 46 supported on the brace allows plunger 49 to extend above lip 47.

Right half 38 of actuator 36 is positioned relative to left half 42 such that boss 51 aligns with the boss secured to left half 42, and plate 53 aligns with the plate secured to left half 42. Having plate 53 aligned with the plate secured to left half 42 results in cutout portion 55 and the cutout portion defined in the plate secured to left half 42 cooperating to define an opening (not shown) through the aligned plates. Once aligned, a screw 44 is screwed into boss 51 and the boss secured to left half 42 so that right half 38 and left half 42 are attached together.

Right half 38 and left half 42 are also positioned relative to column 45 such that a portion of column 45 extends through the above described opening defined in the aligned plates (i.e. plate 53 and the plate secured to left half 42) and lip 47 is interposed between plate 53 and boss 51. It should be understood that the size of lip 47 prevents it from moving through the opening defined in the aligned plates, thereby trapping lip 47 between plate 53 and boss 51.

In addition, left half 42 is positioned relative to housing 24 such that guide pin 40 extends through hole 39. Having right half 38 and left half 42 of actuator 36 positioned in the above described manner results in boss 51 resting on plunger 49. Having boss 51 resting on plunger 49 allows a player (not shown) to repeatedly depress plunger 49 by moving right half 38 and left half 42 in the direction indicated by arrow 61.

Motor 28, gear set 56, gear 58, and gear 60 are mounted on base 26. Gear set 56 is interposed between gear 58 and motor 28. Gear set 56 is also mechanically coupled to gear 58 and motor 28 such that actuation of motor 28 causes gear set 56 and gear 58 to rotate. Gear 58 meshingly engages gear 60 such that rotation of gear 58 causes gear 60 to rotate in the opposite direction relative to gear 58. Base 26 is attached to housing 24 such that motor 28, gear set 56, gear 58, and gear 60 are positioned within interior chamber 25 of housing 24.

One end of shaft 68 is secured to drive foot 64. The end of shaft 68 opposite to the end secured to drive foot 64 is inserted through an opening (not shown) in base 26 and secured to gear 58 via a screw 57. Therefore, drive foot 64 is mechanically coupled to motor 28 (via gear 58 and gear set 56), and actuation of motor 28 causes the rotation of drive foot 64 in the same direction as gear 58. In a similar fashion, one end of shaft 66 is secured to drive foot 62. The end of shaft 66 opposite to the end secured to drive foot 62 is inserted through an opening (not shown) in base 26 and secured to gear 60 via a screw 59. Therefore, drive foot 62 is mechanically coupled to motor 28 (via gear 60, gear 58 and gear set 56), and actuation of motor 28 causes the rotation of drive foot 62 in the same direction as gear 60. However, it should be appreciated that since gear 58 and gear 60 rotate in opposite directions, drive foot 64 and drive foot 62 also rotate in opposite directions upon actuation of motor 28.

Figure 4B:
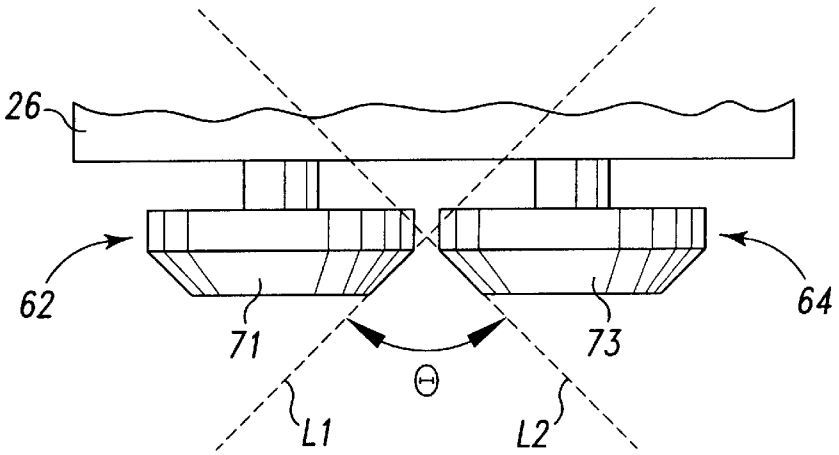
FIG. 4B is a view similar to FIG. 4A, showing the angle defined by the beveled surfaces of the drive feet (note that the rail has been removed for clarity of description)
Figure 4A:
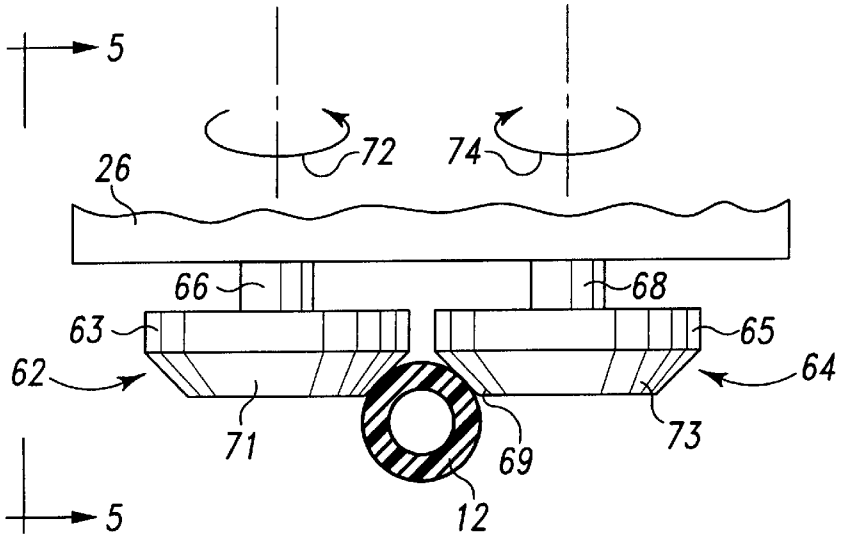
FIG. 4A is an enlarged fragmentary front elevational view of the towing apparatus of FIG. 1, showing the drive feet contacting a portion of the rail (note that the rail is shown in cross section for clarity of description)
Figure 5:
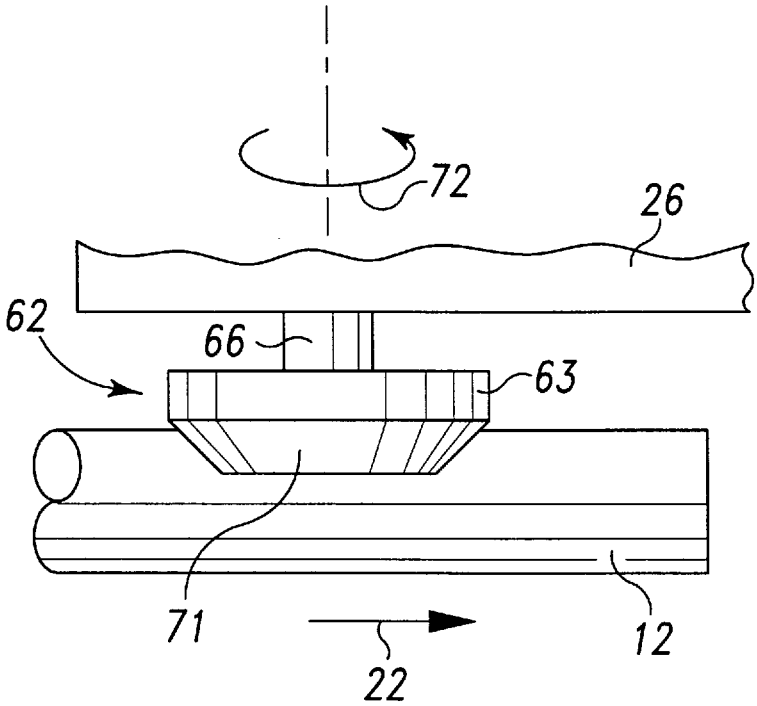
FIG. 5 is a side elevational view of the towing apparatus, taken along the line 5—5 of FIG. 4A as viewed in the direction of the arrows.

As shown more clearly in FIGS. 4A and 5, drive foot 62 includes a rotatable member 63 having a beveled edge 71. Drive foot 64 also includes a rotatable member 65 having a beveled edge 73. Shaft 66 and shaft 68 extend from base 26 such that drive foot 62 and drive foot 64 are spaced apart from each other so as to define a gap 69 therebetween. Towing apparatus 16 (see FIG. 1) is positioned relative to rail 12 such that a portion of rail 12 is located within gap 69 as shown FIG. 4A. Towing apparatus 16 is further positioned relative to rail 12 such that beveled edge 71 and beveled edge 73 engage rail 12 (see FIG. 4A). Having beveled edge 71 and beveled edge 73 engaged with rail 12 results in towing apparatus 16 being advanced along rail 12 in the direction indicated by arrows 22 (see FIGS. 1 and 5) as motor 28 (see FIG. 2) rotates drive foot 62 and drive foot 64 in the directions indicated by arrows 72 and 74 (see FIG. 4A), respectively.

Referring now to FIG. 4B, a linear extension of beveled edge 71 defines a line L1. Similarly, a linear extension of beveled edge 73 defines a line L2. Beveled edges 71 and 73 are positioned relative to one another such that lines L1 and L2 intersect to define an angle Θ which is approximately equal to 90°. What is meant herein by an angle approximately equal to 90° is an angle within the range of 81° to 99°. Having beveled edges 71 and 73 positioned relative to one another in the above described manner enhances the ability of drive foot 62 and drive foot 64 to frictionally engage and propel towing apparatus 16 along rail 12 in the direction indicated by arrow 22 (see FIG. 5).

Figure 3:
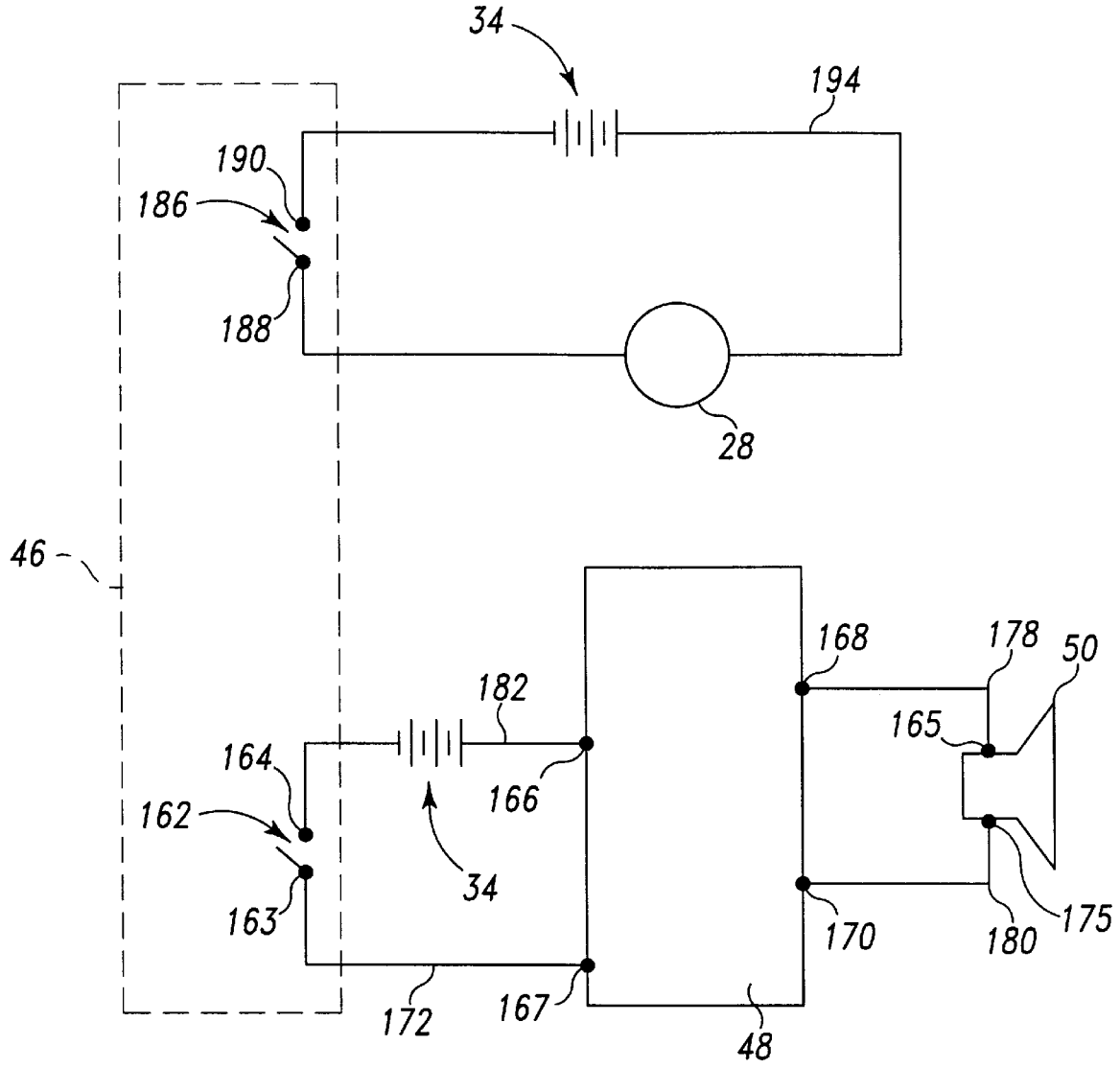
FIG. 3 is a diagram of an electrical circuit of the towing apparatus shown in FIG. 1 that controls the motor, the noise signal generator, and the speaker thereof.

As schematically shown in FIG. 3, switch 46 of actuator 36 (see FIG. 2) is electrically coupled to batteries 34, motor 28, noise signal generator 48, and speaker 50. Switch 46 is a single-pole-double-throw (SPDT) switch having a first throw 186 and a second throw 162. When plunger 49 (see FIG. 2) of switch 46 is depressed, throw 186 electrically connects terminals 188 and 190. Connection of terminals 188 and 190 completes a circuit which electrically couples batteries 34 to motor 28 via a line 194 thereby supplying current to motor 28. Thus, depressing plunger 49 of switch 46 activates motor 28 and causes towing apparatus 16 to advance along rail 12 in the previously described manner.

Depressing plunger 49 also causes throw 162 to electrically connect terminals 163 and 164. Connection of terminals 163 and 164 completes a circuit which electrically couples batteries 34 to a terminal 166 of noise signal generator 48 via line 182. Connecting terminals 163 and 164 also electrically couples terminal 167 of noise signal generator 48 to batteries 34 via a line 172.

An output terminal 168 of noise signal generator 48 is electrically coupled to a terminal 165 of speaker 50 via a line 178. In addition, a terminal 175 of speaker 50 is electrically coupled to a return terminal 170 of noise signal generator 48 via line 180. Thus, it should be appreciated that by depressing plunger 49 of switch 46, current is supplied to noise signal generator 48 which supplies an output signal to speaker 50. As a result of receiving the output signal from noise signal generator 48, speaker 50 creates audible sounds while towing apparatus 16 advances along rail 12. It should be understood that the sounds created by speaker 50 mimic the sounds generated by a real train, e.g. the sounds a real train generates while advancing along a train track and the sound emitted by a train whistle.

When plunger 49 is depressed again, terminals 188 and 190 are electrically isolated thereby electrically decoupling batteries 34 from motor 28 which in turn stops the advancement of towing apparatus 16 along rail 12. In addition, terminals 163 and 164 are also electrically isolated thereby electrically decoupling batteries 34 from noise signal generator 48, which in turn stops the creation of audible sounds by speaker 50. Therefore, it should be appreciated that speaker 50 only creates audible sounds while motor 28 is actuated and towing apparatus 16 is advanced along rail 12. However, it should also be appreciated that depressing plunger 49 again reconnects terminals 188 and 190 and terminals 163 and 164 such that towing apparatus 16 is again advanced along rail 12 and audible sounds are again created by speaker 50. In addition, it should be understood that plunger 49 can be depressed any number of times so as to repeatedly start and stop the advancement of towing apparatus 16 along rail 12 and the creation of audible sounds by speaker 50.

Figure 6:
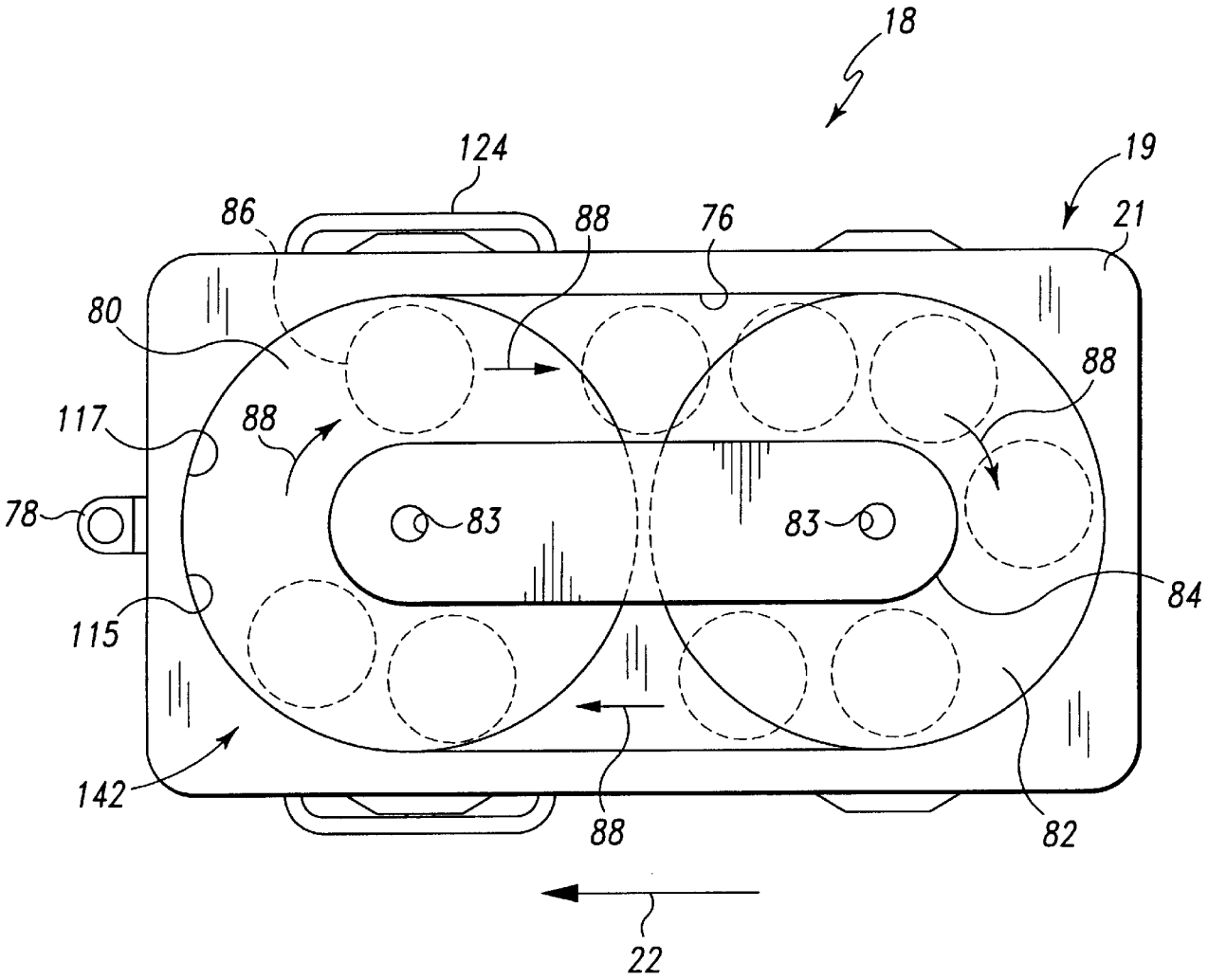
FIG. 6 is an enlarged top elevational view of the movement device of the transport apparatus shown in FIG. 1, with the game pieces shown in phantom for clarity of description.
Figure 7:
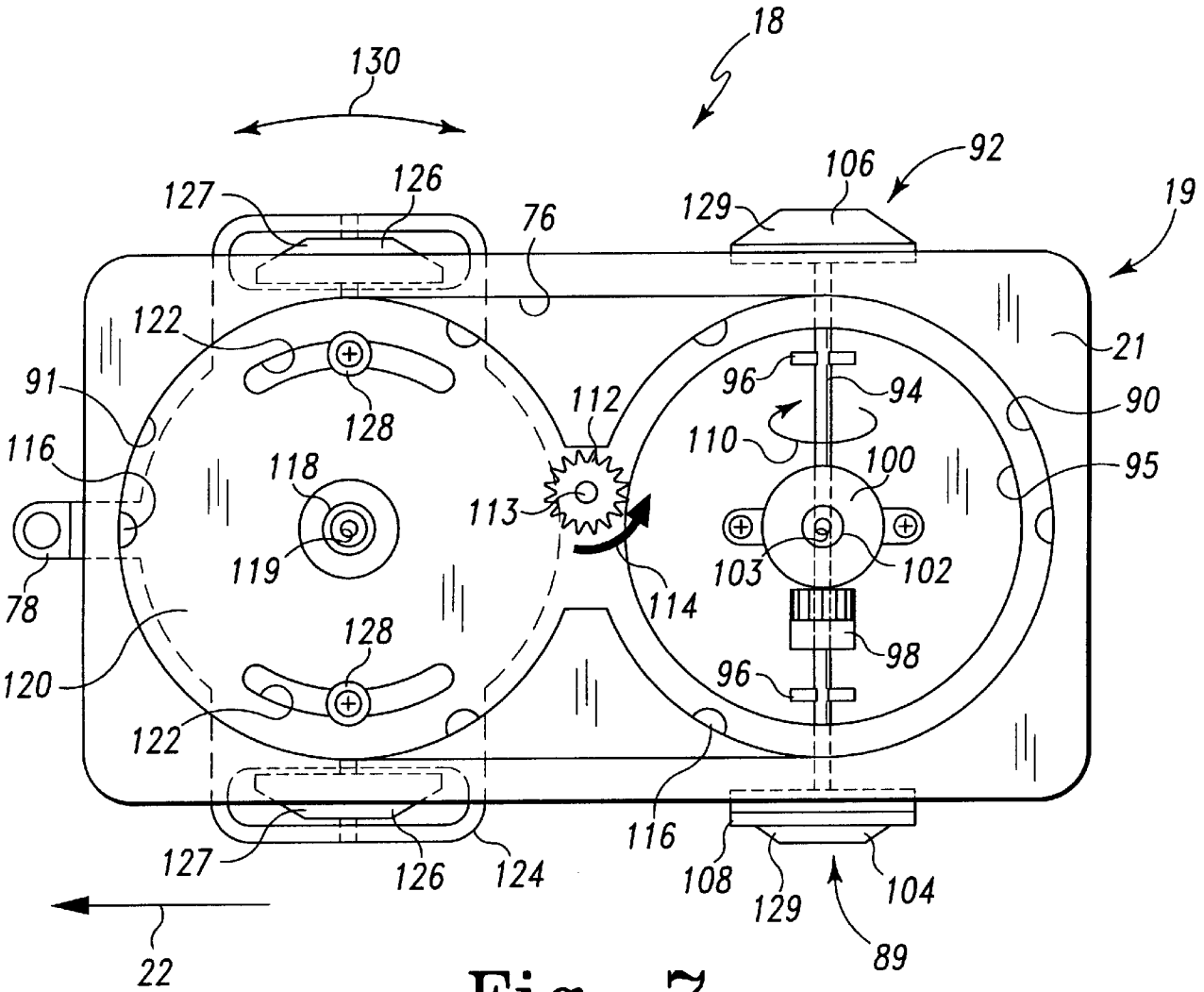
FIG. 7 is a view similar to FIG. 6, but with certain parts of the movement device and the game pieces shown removed for clarity of description.

Referring now to FIGS. 6 and 7, movement device 18 includes a support 19, an undercarriage 124, and a coupler 89. Movement device 18 also includes a center body 84, a platform 142, an intermediate gear 112, and a pedestal 100 having a rod 102 extending therefrom. Rod 102 has an internally threaded bore 103 defined therein.

As shown in FIG. 7, support 19 includes a cart 21. Cart 21 has a recessed area 76 defined therein. Recessed area 76 includes a circular cavity 90 and a circular cavity 91. Cart 19 also includes a floor 120, a number of bearing structures 116, a peg 113, and a finger 118. Finger 118 has an internally threaded bore 119 defined therein. The portion of floor 120 located within circular cavity 91 has a pair of steering slots 122 defined therein. Several bearing structures 116 are positioned within circular cavity 91. In addition, several bearing structures 116 are positioned within circular cavity 90. Peg 113 extends upwardly from floor 120 and is interposed between circular cavity 90 and circular cavity 91. Intermediate gear 112 is mounted on peg 113 such that intermediate gear 112 can rotate relative to cart 21 in a direction indicated by arrow 114 and a direction opposite to the direction indicated by arrow 114. Finger 118 also extends upwardly from floor 120 and is positioned within circular cavity 91. Pedestal 100 is attached to cart 21 such that it extends upwardly from floor 120 and is positioned within circular cavity 90.

Undercarriage 124 includes a hitch receptacle 78. Undercarriage 124 also includes wheels 126 rotatably mounted thereto. Each wheel 126 has a beveled edge 127 formed thereon. It should be appreciated that rail 12 is typically positioned interposed between wheels 126 as shown in FIG. 1. However, if either one of wheels 126 happen to roll over rail 12 during a game playing period such that rail 12 is no longer interposed between wheels 126, beveled edges 127 facilitate the ability of wheel 126 being able to role back over rail 12 so as to reposition rail 12 between wheels 126.

The ability of wheels 126 to roll back over rail 12 improves the ability of movement device 18 to track behind towing apparatus 16 as transport apparatus 14 moves along rail 12.

Undercarriage 124 is attached to cart 21 by inserting a screw 128 through each steering slot 122. Each screw 128 is then screwed into an internally threaded boss (not shown) secured to undercarriage 124. Attaching undercarriage 124 to cart 21 in the above described manner allows screws 128 to slide in steering slots 122 thereby allowing undercarriage 124 to rotate relative to cart 21 in the directions indicated by arrow 130. The ability of undercarriage 124 to rotate relative to cart 21 in the above described manner also improves the ability of movement device 18 to track behind towing apparatus 16 as transport apparatus 14 moves along rail 12.

Coupler 89 includes an axle assembly 92. Axle assembly 92 includes an axle 94 and wheels 104 and 106. Wheel 104 includes a traction band 108 attached thereto. Wheel 104 also has a beveled edge 129 formed thereon. Wheel 106 also has a beveled edge 129 formed thereon. Beveled edges 129 serve the same purpose as described above in reference to beveled edges 127. Axle assembly 92 also includes a drive gear 98 secured to axle 94. Wheels 104 and 106, and drive gear 98 do not rotate relative to axle 94. Axle assembly 92 is secured to cart 21 by inserting axle 94 through a pair of openings (not shown) defined in a side wall 95 of circular cavity 90. Axle 94 is inserted through a channel (not shown) defined in pedestal 100 such that drive gear 98 is adjacent to pedestal 100. Axle 94 is also inserted through a pair of U-shaped brackets 96 attached to, and extending upwardly from, floor 120. Securing axle assembly 92 to cart 21 in the above described manner positions wheels 104 and 106 outside of recessed area 76, and allows axle assembly 92 (including drive gear 98) to rotate relative to cart 21 in the direction indicated by arrow 110. Axle assembly 92 can also rotate relative to the cart 21 in the direction opposite to the direction indicated by arrow 110.

Figure 8:
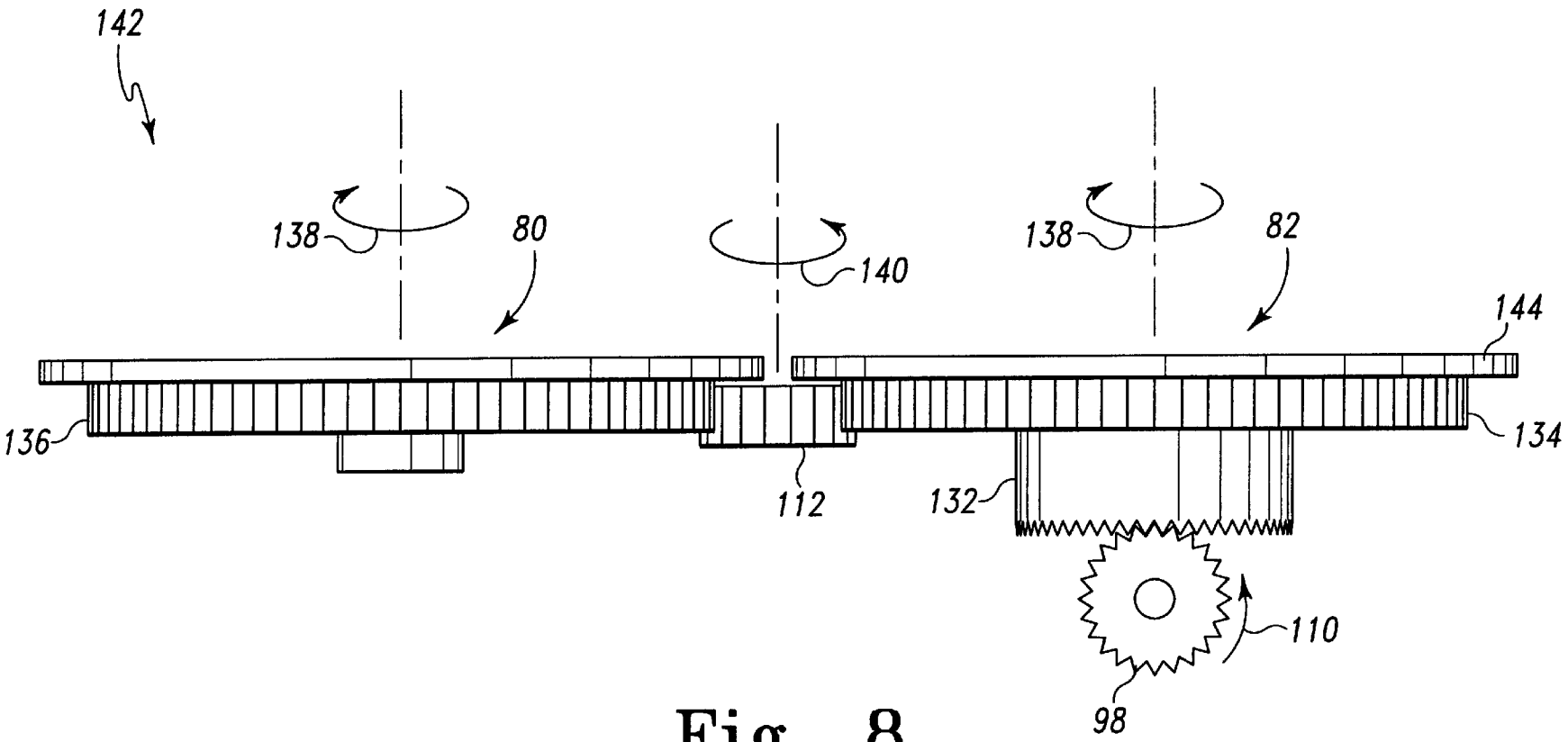
FIG. 8 is an enlarged side elevational view of the turntables and the intermediate gear of the movement device shown in FIG. 6.
Figure 9:
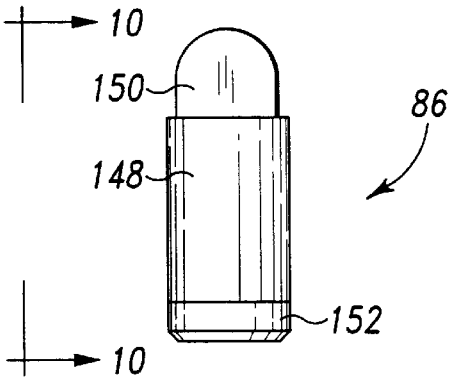
FIG. 9 is an enlarged front elevational view of a game piece of the game shown in FIG. 1.
Figure 10:
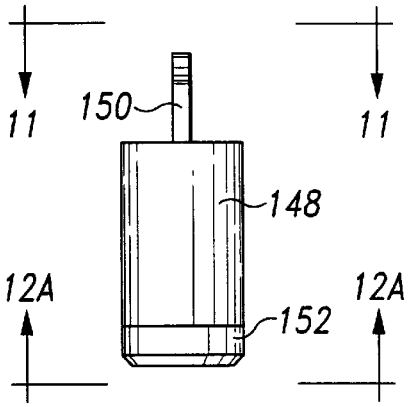
FIG. 10 is a side elevational view of the game piece, taken along line 10—10 of FIG. 9 as viewed in the direction of the arrows.
Figure 11:
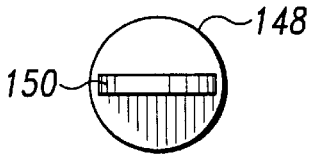
FIG. 11 is a top elevational view of the game piece, taken along line 11—11 of FIG. 10 as viewed in the direction of the arrows.
Figure 12A:
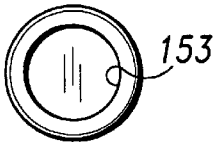
FIG. 12A is a bottom elevational view of the game piece, taken along line 12A—12A of FIG. 10 as viewed in the direction of the arrows showing the recessed area of the plug.
Figure 12B:
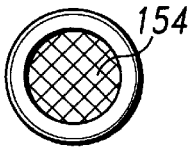
FIG. 12B is a view similar to the view shown in FIG. 12A, but showing an indicia positioned in the recessed area of the plug.
Figure 13:
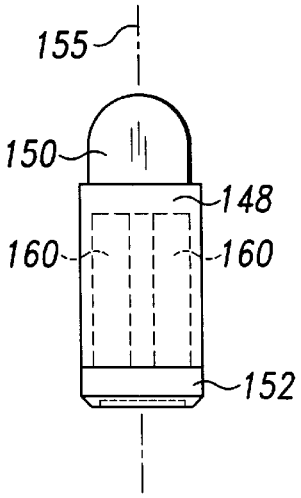
FIG. 13 is a view similar to the view shown in FIG. 9, but showing the plates of the plug in phantom for clarity of description.

Referring now to FIGS. 6 and 8, platform 142 includes a turntable 80 and a turntable 82. Turntable 80 has a gear 136 attached thereto. Turntable 82 has a gear 134 and a gear 132 attached thereto. Turntable 80 is positioned within circular cavity 91 (see FIG. 7) of cart 21 as shown in FIG. 6 such that turntable 80 rests on bearing structures 116. Turntable 80 is further positioned in circular cavity 91 such that finger 118 (see FIG. 7) extends through an opening (not shown) in the center of turntable 80. Positioning turntable 80 in the above described manner locates gear 136 in meshing engagement with intermediate gear 112 (see FIG. 8). Turntable 82 is positioned within circular cavity 90 (see FIG. 7) of cart 21 as shown in FIG. 6 such that turntable 82 rests on bearing structures 116. Turntable 82 is further positioned within circular cavity 90 such that rod 102 (see FIG. 7) of pedestal 100 extends through an opening (not shown) in the center of turntable 82. Positioning turntable 82 in the above described manner locates gear 134 in meshing engagement with intermediate gear 112 (see FIG. 8). Positioning turntable 82 in the above described manner also locates gear 132 in meshing engagement with drive gear 98 (see FIG. 8).

As shown in FIG. 6, center body 84 is positioned within recessed area 76 in contact with turntables 80 and 82. Center body 84 is further positioned within recessed area 76 such that screw holes 83 defined in center body 84 align with internally threaded bores 103 and 119 of finger 118 and rod 102 (see FIG. 7), respectively. Screws (not shown) are then inserted through screw holes 83 and screwed into internally threaded bores 103 and 119 to secure center body 84 to cart 21. Securing center body 84 to cart 21 in the above described manner holds turntables 80 and 82 within circular cavities 91 and 90, respectively. Securing center body 84 to cart 21 in the above described manner also defines a channel 115 interposed between center body 84 and a side wall 117 of cart 21.

As shown in FIG. 8, having drive gear 98 secured to axle 94 (see FIG. 7) and meshingly engaged with gear 132 (see FIG. 8) causes gear 132 to rotate in a direction indicated by arrow 138 when axle 94 and drive gear 98 rotate in the direction indicated by arrow 110. The rotation of gear 132 also causes the rotation of gear 134 and turntable 82 in the direction indicated by arrow 138. The rotation of gear 134 causes the rotation of intermediate gear 112 in a direction indicated by arrow 140. The rotation of intermediate gear 112 causes the rotation of gear 136 and turntable 80 in a direction indicated by arrow 139. Therefore, it should be understood that the rotation of wheels 104 and 106 of axle assembly 92 causes the rotation of turntables 80 and 82 relative to cart 21.

Figure 14:
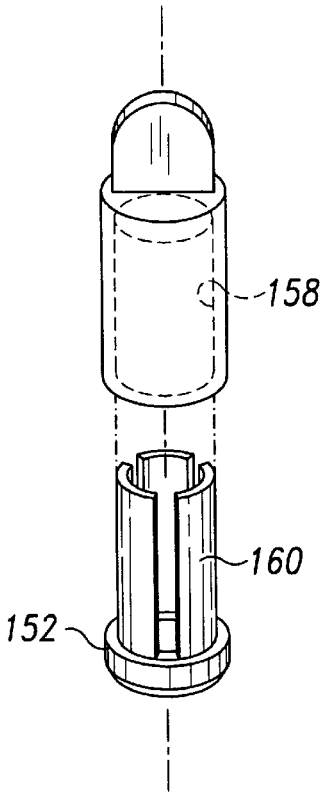
FIG. 14 is an exploded perspective view of the game piece shown in FIG. 13, with the void of the game piece shown in phantom for clarity of description.

Referring now to FIGS. 9–14, each game piece 86 includes a body 148 having a void 158 defined therein, a head 150, and a plug 152. Plug 152 includes a number of plates 160, a notch area 153, and an indicia 154. Indicia 154 is attached to plug 152 such that indicia 154 is positioned within notch area 153. It should be understood that indicia 154 can be, for example, a color, a number, or a letter. Head 150 extends from an end of body 148. Plug 152 is positioned relative to body 148 such that plates 160 extend into void 158. Having plates 160 positioned within void 158 secures plug 152 to body 148. However, it should be understood that plug 152 can be detached from body 148 as shown in FIG. 14. Having plug 152 completely detachable from body 148 is an important aspect of the present invention since it allows plugs 152 and bodies 148 to be interchanged. Interchanging plugs 152 and bodies 148 prevents the indicia 154 attached to a particular plug 152 from being associated with a particular body 148 or head 150.

Head 150 may have one decoration (not shown) of a plurality of decorations visibly displayed thereon. For example, head 150 may have a decoration visibly displayed thereon which resembles a person's face. Body 148 may also have one decoration (not shown) of a plurality of decorations visibly displayed thereon. For example, body 148 may have a decoration attached thereto which resembles a person's arms, legs, and clothing. Note that FIG. 1 shows twelve game pieces 86 being supported by movement device 18. Further note that each game piece 86 has a distinct face attached to the head 150, and distinct clothing, legs, and arms attached to the body 148. This results in twelve game pieces 86, each having distinct characteristics relative to each other.

During a game playing period, towing apparatus 16 is positioned relative to rail 12 as discussed above in reference to FIGS. 4A and 5. In addition, hitch receptacle 78 (see FIG. 6) of movement device 18 is attached to hitch 70 (see FIG.2) of towing apparatus 16 as shown in FIG. 1. A number of game pieces 86 are then positioned within channel 115 of movement device 18 such that game pieces 86 are supported on turntables 80 and 82 (see FIG. 6). Game pieces 86 are further positioned within channel 115 such that no indicia 154 attached to any plug 152 is visible to any player.

Towing apparatus 16 is then actuated as previously described so that movement device 18 is transported along rail 12 with towing apparatus 16 in the direction indicated by arrows 22 (see FIG. 1). It should be understood that towing apparatus 16 transports movement device 18 from a first location to a second location along a predetermined path of movement as defined by rail 12. As movement device 18 is being transported along rail 12, traction band 108 (see FIG. 7) frictionally engages the surface which supports rail 12 such that wheel 104 and axle 94 rotate in the direction indicated by arrow 110 (see FIG. 7). Rotation of axle 94 causes drive gear 98 to also rotate in the same direction. As shown in FIG. 6, rotation of drive gear 98 causes the rotation of turntables 80 and 82 relative to cart 21 in the direction indicated by arrows 88. Since game pieces 86 are supported on turntables 80 and 82, game pieces 86 also move in the direction indicated by arrows 88 in a circuitous path of movement defined by channel 115. In addition, each game piece 86 rotates about its longitudinal axis 155 (see FIG. 13) as the game piece 86 is moved in channel 115. The above described circuitous movement of game pieces 86 is an important aspect of the present invention since it recirculates the game pieces 86 during performance of the game 10.

How the Game is Played

A game playing period is initiated by positioning the components of game 10 as shown in FIG. 1. Specifically, rail 12 is positioned so as to define a predetermined path for towing apparatus 16 to follow, and the four game piece indicators 20A, 20B, 20C, and 20D are positioned around rail 12. In addition, each game piece indicator 20A, 20B, 20C, and 20D has one player (not shown) positioned adjacent thereto. Towing apparatus 16 is then positioned relative to rail 12 as discussed above in reference to FIGS. 4A and 5. Movement device 18 is then coupled to towing apparatus 16, as previously discussed, to define transport apparatus 14. Transport apparatus 14 is initially positioned on rail 12 such that transport apparatus 14 is located adjacent to game piece indicator 20A as shown in FIG. 1. It should be understood that when transport apparatus 14 is positioned adjacent game piece indicator 20A, transport apparatus 14 is located at the first location. Game pieces 86 are then positioned within channel 115 (see FIG. 6) of movement device 18 such that no indicia 154 attached to any plug 152 is visible to any player.

The player adjacent to game piece indicator 20A then depresses actuator 36 so as to cause transport apparatus 14 to move in the direction indicated by arrows 22 (se FIG. 1). Once transport apparatus 14 advances to a position adjacent to game piece indicator 20B, i.e. the second location, the player adjacent to game piece indicator 20B depresses actuator 36 so as to stop transport apparatus 14. The player adjacent to game piece indicator 20B then selects a first game piece 86 which he or she believes has an indicia 154 (see FIG. 12B) attached thereto that matches the indicia displayed on game piece indicator 20B. The first game piece 86 is retained at the second location if indicia 154 displayed on first game piece 86 matches the indicia displayed on game piece indicator 20B. Alternatively, if the indicia 154 attached to first game piece 86 does not match the indicia displayed on game piece indicator 20B, the player adjacent to game piece indicator 20B positions first game piece 86 such that every player can see the indicia 154 attached to first game piece 86. Once the indicia 154 attached to first game piece 86 has been shown to every player, first game piece 86 is returned to channel 115 of movement device 18 such that the indicia 154 is no longer visible to any player.

The player adjacent to game piece indicator 20B then depresses actuator 36 again so as to cause transport apparatus 14 to again move in the direction indicated by arrows 22 (see FIG. 1). Once transport apparatus 14 advances to a position adjacent to game piece indicator 20C, i.e. the third location, the player adjacent to game piece indicator 20C depresses actuator 36 so as to stop transport apparatus 14. The player adjacent to game piece indicator 20C then selects a second game piece 86 which he or she believes has an indicia 154 (see FIG. 12B) attached thereto that matches the indicia displayed on game piece indicator 20C. The second game piece 86 is retained at the third location if indicia 154 displayed on the second game piece 86 matches the indicia displayed on game piece indicator 20C. Alternatively, if the indicia 154 attached to second game piece 86 does not match the indicia displayed on game piece indicator 20C, the player adjacent to game piece indicator 20C positions second game piece 86 such that every player can see the indicia 154 attached to second game piece 86. Once the indicia 154 attached to second game piece 86 has been shown to every player, second game piece 86 is returned to channel 115 of movement device 18 such that the indicia 154 is no longer visible to any player.

The player adjacent to game piece indicator 20C then depresses actuator 36 again so as to cause transport apparatus 14 to again move in the direction indicated by arrows 22 (see FIG. 1). Once transport apparatus 14 advances to a position adjacent to game piece indicator 20D, i.e. the fourth location, the player adjacent to game piece indicator 20D depresses actuator 36 so as to stop transport apparatus 14. Once transport apparatus 14 stops at the fourth location the above described procedure is repeated for selecting a third game piece 86. Once the selecting procedure has been performed the player adjacent to game piece indicator 20D depresses actuator 36 again to cause transport apparatus 14 to move in the direction of arrows 22, i.e. toward game piece indicator 20A and the first location, where the above described game piece 86 selecting procedure is again repeated.

It should be understood that transport apparatus 14 is sequentially moved around rail 12 in the above described manner until one player has collected the three games pieces 86 which have attached thereto the indicia 154 that match the indicia displayed on their game piece indicator. For example, if the indicia displayed on game piece indicator 20A is three blue dots, and the player positioned adjacent game piece indicator 20A collects three game pieces 86 that have a blue dot attached thereto for indicia 154, before any other player collects his or her appropriate game pieces 86, the player adjacent to game piece indicator 20A is declared the winner of game 10.

It should also be understood that movement device 18 recirculates game pieces 86 in channel 115 while being towed by towing apparatus 16. This recirculation makes selecting the appropriate game piece 86 by a player more challenging as compared to a game where the game pieces 86 do not move. Thus, movement device 18 increases the value of the educational and memory exercise, and helps maintain a child's interest in game 10.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, it should be understood that while the hitch 70 of towing apparatus 16 is coupled to the hitch receptacle 78 of movement device 18 such that towing apparatus 16 pulls the movement device 18 in the direction indicated by arrows 22 (see FIG. 1), towing apparatus 16 could also be coupled to movement device 18 such that the towing apparatus 16 pushes movement device 18 along the track 12. Furthermore, towing apparatus 16 and movement device 18 could be integrated into a single unit as opposed to two separate units as described above. In addition, while game 10 is described above as being played with four players, it should be appreciated that any number of players can play game 10.

What is claimed is:

1. An apparatus for moving game pieces during a game playing period, comprising:

a movement device having a support which supports a number of game pieces, said movement device moves said number of game pieces relative to said support during said game playing period; and a towing apparatus for transporting said movement device from a first location to a second location during said game playing period, said towing apparatus being movable in a predetermined path of movement, wherein (i) said movement device further includes a platform, (ii) said platform is movable in relation to said support during said game playing period, and (iii) said number of game pieces are supported on said platform, wherein (i) said platform includes (1) a first turntable rotatably coupled to said support, and (2) a second turntable rotatably coupled to said support, and (ii) said first turntable and said second turntable rotate in relation to said support, and wherein (i) said support includes a cart having a recessed area defined therein, (ii) said first turntable is located within said recess, (iii) said second turntable is located within said recess, and (iv) said number of game pieces are supported on said first turntable and said second turntable during said game playing period.

2. The apparatus of claim 1, wherein:

said number of game pieces are moved in a circuitous path of movement during said game playing period.

3. An apparatus for moving game pieces during a game playing period, comprising:

a movement device having a support which supports a number of game pieces, said movement device moves said number of game pieces relative to said support during said game playing period;

a towing apparatus for transporting said movement device from a first location to a second location during said game playing period, wherein said towing apparatus is movable in a predetermined path of movement, (ii) said movement device further includes a platform, (iii) said platform is movable in relation to said support during said game playing period, (iv) said number of game pieces are supported on said platform, (v) said platform includes (1) a first turntable rotatably coupled to said support, and (2) a second turntable rotatably coupled to said support, and (vi) said first turntable and said second turntable rotate in relation to said support;

a wheel secured to said support;

a coupler which mechanically couples said platform to said wheel, wherein rotation of said wheel causes movement of said platform; and wherein (i) said coupler includes a gear set which mechanically couples said wheel to said first turntable and said second turntable, and (ii) rotation of said wheel causes rotation of said first turntable and said second turntable.

4. An apparatus for moving game pieces during a game playing period, comprising:

a movement device having a support which supports a number of game pieces, said movement device moves said number of game pieces relative to said support during said game playing period;

a towing apparatus for transporting said movement device from a first location to a second location during said game playing period, said towing apparatus being movable in a predetermined path of movement;

a rail for guiding said towing apparatus in said predetermined path of movement, wherein said towing apparatus comprises (i) a first drive foot which engages said rail, and (ii) a motor mechanically coupled to said first drive foot for rotating said first drive foot so as to advance said towing apparatus along said rail; and a second drive foot which engages said rail, said second drive foot being spaced apart from said first drive foot so as to define a gap in which said rail is positioned, wherein said second drive foot is mechanically coupled to said motor for rotating said second drive foot so as to advance said towing apparatus along said rail.

5. The apparatus of claim 4, wherein:

said first drive foot includes (1) a first rotatable member having a first beveled edge which contacts said rail and (2) a first shaft extending from said first rotatable member and mechanically coupled to said motor, and said second drive foot includes (1) a second rotatable member having a second beveled edge which contacts said rail and (2) a second shaft extending from said second rotatable member and mechanically coupled to said motor.

6. The apparatus of claim 5, wherein:

a first linear extension of said first beveled edge defines a first line, a second linear extension of said second beveled edge defines a second line, and said first line and said second line intersect to define an angle which is equal to approximately 90°.

7. An apparatus for moving game pieces during a game playing period, comprising:

a rail;

a support for holding a number of game pieces; and a towing apparatus for transporting said support from a first location to a second location during said game playing period, wherein said towing apparatus includes (1) a first drive foot which engages said rail, and (2) a motor mechanically coupled to said first drive foot for rotating said first drive foot so as to advance said towing apparatus along said rail, wherein said towing apparatus further includes a second drive foot which engages said rail, said second drive foot being spaced apart from said first drive foot so as to define a gap in which said rail is positioned.

8. The apparatus of claim 7, wherein:

said second drive foot is mechanically coupled to said motor, and a gear set mechanically couples said first drive foot and said second drive foot to said motor.

9. The apparatus of claim 8, wherein each of said first drive foot and said second drive foot includes:

a rotatable member having a beveled edge which contacts said rail, and a shaft extending from said rotatable member and coupled to said gear set.

* * * * *